US005278737A

United States Patent [19]

Luce et al.

[11] Patent Number: 5,278,737

[45] Date of Patent: Jan. 11, 1994

[54] WALL AND CEILING LIGHTING UNIT

[75] Inventors: Ron Luce, Hartford; Mark J. Hastings, New Berlin; Robert T. Allen, Wauwatosa, all of Wis.; Ian Lewin, Scottsdale, Ariz.

[73] Assignee: Visa Lighting Corporation, Milwaukee, Wis.

[21] Appl. No.: 788,789

[22] Filed: Nov. 6, 1991

[51] Int. Cl.[5] ..... F21S 1/02

[52] U.S. Cl. ..... 362/147; 362/298; 362/346

[58] Field of Search ..... 362/147, 223, 296, 297, 362/346, 347, 349, 350, 345, 298

[56] References Cited

U.S. PATENT DOCUMENTS

| | | | |
|---|---|---|---|
| 2,032,622 | 3/1936 | Guillou | 362/349 |
| 3,679,893 | 7/1972 | Shemitz et al. | 362/346 |
| 3,710,094 | 1/1973 | Monte et al. | 362/218 |
| 4,027,151 | 5/1977 | Barthel | 240/103 |
| 4,065,667 | 12/1977 | Ruud et al. | 362/297 |
| 4,229,779 | 10/1980 | Bilson et al. | 362/296 |
| 4,709,312 | 11/1987 | Heinisch et al. | 362/298 |
| 4,748,543 | 5/1988 | Swarens | 362/147 |

FOREIGN PATENT DOCUMENTS

| | | | |
|---|---|---|---|
| 387443 | 2/1933 | United Kingdom | 362/349 |

*Primary Examiner*—Ira S. Lazarus
*Assistant Examiner*—Y. Quach
*Attorney, Agent, or Firm*—Reinhart, Boerner, Van Deuren, Norris & Rieselbach

[57] ABSTRACT

A lighting unit for illuminating a wall and adjacent ceiling area. The lighting unit includes a primary reflection element having a curved portion and a smoothly coupled planar portion. A light source is positioned within the lighting unit and a diffuser element can be used to obtain a desired illumination distribution.

23 Claims, 4 Drawing Sheets

| REGION OF REFLECTION | GEOMETRIC DESCRIPTION | MATHEMATICAL DESCRIPTION | REGION LIMITS FROM LIGHT SOURCE OFF MADIR |
|---|---|---|---|
| A | PARABOLIC | $Y^2=4px$ | 222.0° TO 45.0° |
| B | CIRCULAR | r=5.033p | 45.0° TO 80.9° |
| C | PLANAR | SLOPE=0.521 | 80.9° TO 97.3° |
| D | PLANAR | SLOPE=0.000 | 97.3° TO 222.2° |

Fig. 1A
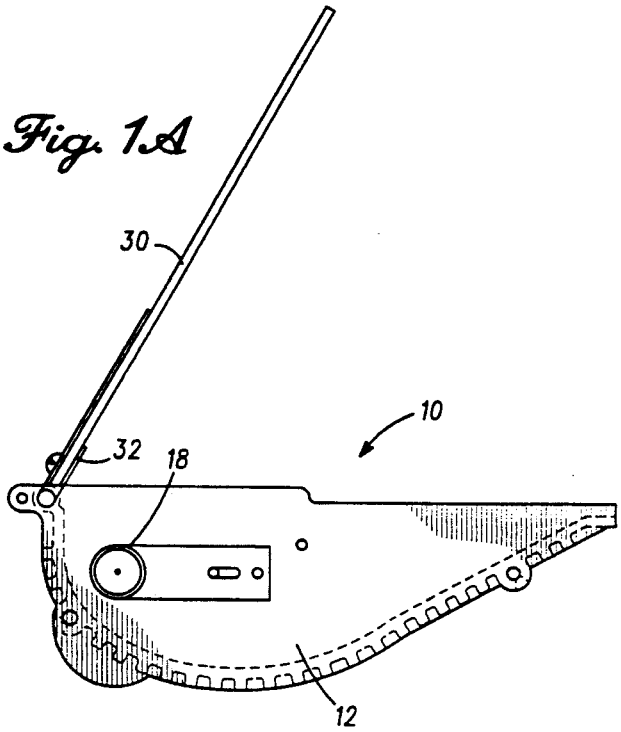
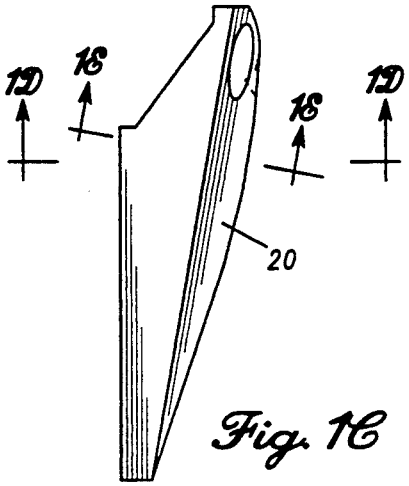
Fig. 1C
Fig. 1D
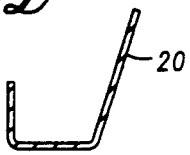
Fig. 1B
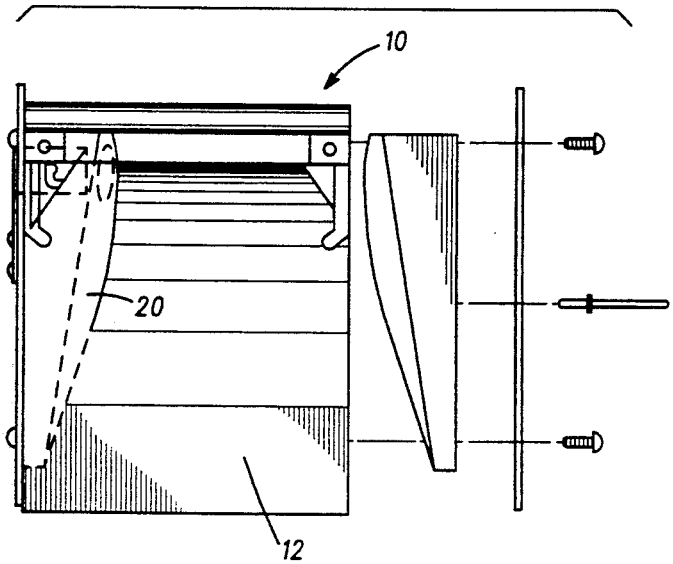
Fig. 1E
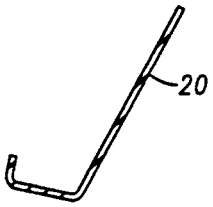

| REGION OF REFLECTION | GEOMETRIC DESCRIPTION | MATHEMATICAL DESCRIPTION | REGION LIMITS FROM LIGHT SOURCE OFF MADIR |
|---|---|---|---|
| A | PARABOLIC | $Y^2=4px$ | 222.0° TO 45.0° |
| B | CIRCULAR | r=5.033p | 45.0° TO 80.9° |
| C | PLANAR | SLOPE=0.521 | 80.9° TO 97.3° |
| D | PLANAR | SLOPE=0.000 | 97.3° TO 222.2° |

WALL AND CEILING LIGHTING UNIT

The present invention is concerned generally with a lighting unit for providing illumination onto a wall and adjacent ceiling. More particularly, the invention is related to a lighting unit for providing controlled levels of illumination onto an upper wall area and an immediately adjoining ceiling area.

A wide variety of light illumination systems exist in the prior art. The control of light patterns has numerous applications, such as for highway signs, street or car lights for a road surface, illuminating a living or work space without glare, lighting a wall with a desired pattern of light or lighting a ceiling area in a preselected pattern. These prior art references have been directed to providing illumination patterns primarily for a single planar area, such as a wall, a ceiling, a sign, or a road surface. These prior art references, however, have taught embodiments which are inefficient as a total luminaire. Frequently, prior art lighting fixtures generate a highly concentrated light pattern at one point or generate a plurality of points of light for providing overlapping light patterns in an attempt to generate a uniform illumination pattern. There have been a few attempts to produce controlled light distribution across two intersecting surfaces (such as a wall and ceiling), but these prior art fixtures do not achieve good uniformity nor do they have adequate lighting efficiency.

It is therefore an object of the invention to provide an improved indirect lighting fixture.

It is a further object of the invention to provide a novel lighting fixture generating a smoothly varying and controlled light intensity over the wall area above the fixture and the immediately adjoining area of the ceiling.

It is an additional object of the invention to provide an improved lighting fixture having two primary reflecting surface geometries for generating uniform illumination on two intersecting areas above the fixture.

It is another object of the invention to provide a novel tungsten-halogen (quartz) lamp of about 63% total luminaire efficiency while using reduced power for operation.

It is yet a further object of the invention to provide an improved lighting fixture having an illumination pattern derived from a plurality of direct and reflective illumination patterns enabling a controlled and highly efficient lighting of intersecting two dimensional surfaces.

It is still a further object of the invention to provide a lighting unit with reflecting surfaces adapted to generate a substantially uniform, controlled illumination of a wall and adjoining ceiling area.

It is still an additional object of the invention to provide an improved light reflection unit having a curved portion and a smoothly and integrally coupled planar portion.

Other objects, features and advantages of the present invention will be readily apparent from the following description of the preferred embodiments thereof, taken in conjunction with the accompanying drawings described below wherein like elements have like numerals throughout the several views.

DESCRIPTION OF THE DRAWINGS

FIG. 1A illustrates a side view of a lighting unit of the invention; FIG. 1B shows a general top view of the lighting unit; FIG. 1C illustrates a partial top view of the side reflector panels of the lighting unit; FIG. 1D shows a partial cross sectional view taken along 1D—1D in FIG. 1C; FIG. 1E shows a partial cross sectional view taken along 1E—1E in FIG. 1C.

DETAILED DESCRIPTION OF THE PREFERRED EMBODIMENTS

Figure 1F:
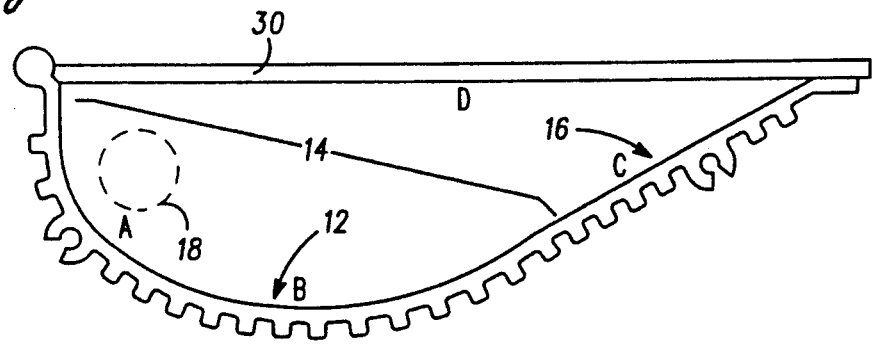
FIG. 1F is a detailed to scale representation and mathematical characterization of the lighting unit in FIG. 1A.
Figure 2:
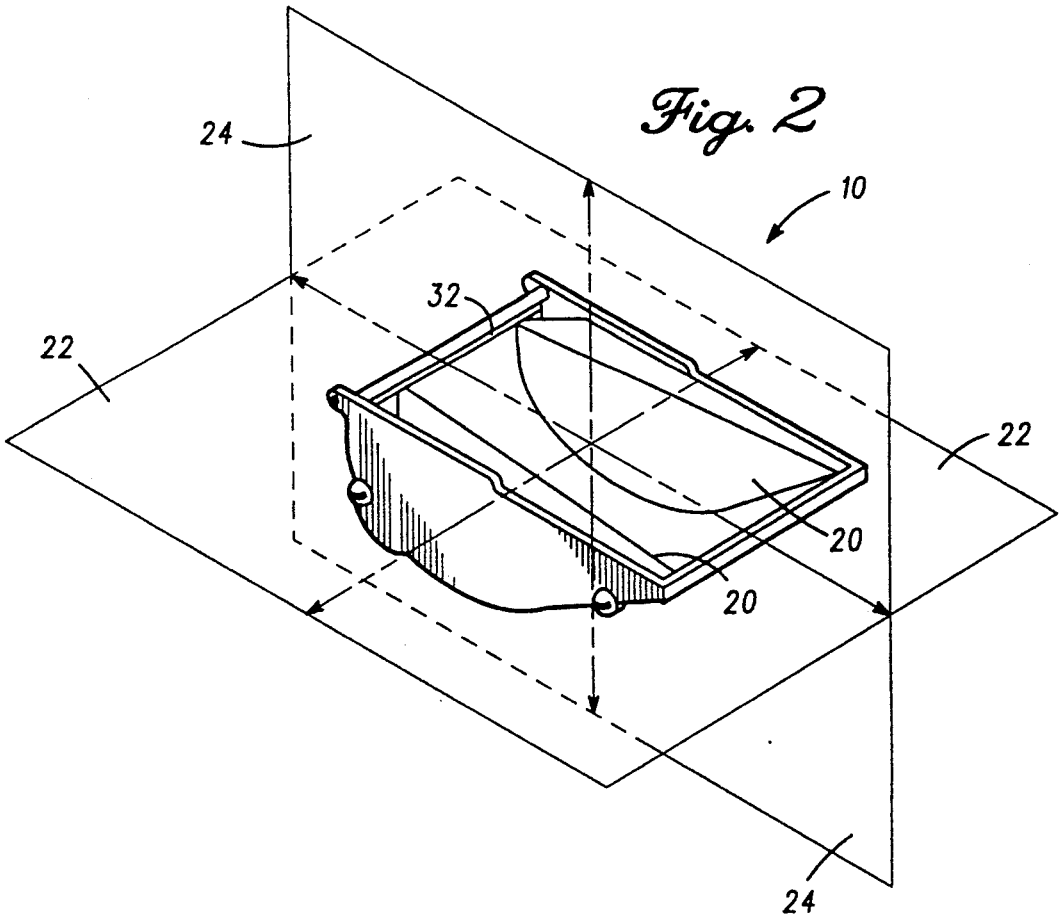
FIG. 2 is a perspective view of the lighting unit and the defined planes of light illumination.

A lighting unit 10 constructed in accordance with the invention is shown generally in FIGS. 1 and 2. As shown best in FIGS. 1A and 1F, an optically polished primary reflection element 12 has a curved portion 14 and substantially flattened planar portion 16. Any one of a plurality of conventional optical materials can be used, such as polished aluminum or a mirrored surface on a support. The curved portion 14 can be semi-parabolic in cross section and has been iteratively modified to provide the high efficiency obtained for illumination of the preferred embodiment. Details of the mathematical equations descriptive of the primary reflection elements 12 are illustrated in FIG. 1F for the preferred embodiments. Details of this efficiency and the angular distribution of the illumination pattern are shown in FIGS. 4 and 5 and in Tables I-IV discussed hereinafter. A preferred light source 18 is a conventional tungsten-halogen (quartz) sources of up to 500 watts power. This light source 18 is disposed relative to the primary reflection element 12 as shown in the "to-scale" drawings of FIG. 1 (also see detailed dimensions of the to-scale drawing of FIG. 1F). The lighting unit 10 also includes optically polished side reflector elements 20 shown in FIGS. 1B, and the preferred orientation of the side reflector elements 20 is best shown in FIGS. 1C, 1D and 1E.

FIG. 2 illustrates a perspective view of the lighting unit 10 and the defined angles within planes of illumination. In order to quantitatively evaluate the performance of the lighting unit 10, a series of standard illumination tests were performed. First, the candela distribution of light from the lighting unit 10 was determined wherein a candela is a conventional unit of measure in illumination analogous to pressure in fluid flow tests. In Table I are shown candela units over angular position in a horizontal plane 22 and vertical plane 24 (see FIG. 2). Thus, the angles (in degrees) of 0.0, 22.5, 45.0, 67.5, etc. are the angular directional components along the horizontal plane 22 with 0.0° the angular direction directly forward of the lighting unit 10, and 180.0°

TABLE I

| VERTICAL PLANAR ANGLE | CANDELA DISTRIBUTION — HORIZONTAL PLANAR ANGLE 0.0 | 22.5 | 45.0 | 67.5 | 90.0 | 112.5 | 135.0 | 157.5 | 180.0 |
|---|---|---|---|---|---|---|---|---|---|
| 90.0 | 0 | 0 | 0 | 0 | 0 | 0 | 0 | 0 | 0 |
| 92.5 | 47 | 55 | 40 | 16 | 0 | 0 | 0 | 0 | 0 |
| 95.0 | 127 | 119 | 71 | 24 | 8 | 0 | 8 | 8 | 0 |
| 97.5 | 206 | 190 | 119 | 40 | 16 | 16 | 16 | 16 | 16 |
| 100.0 | 301 | 285 | 182 | 71 | 24 | 16 | 16 | 16 | 16 |
| 102.5 | 427 | 404 | 237 | 95 | 40 | 16 | 24 | 16 | 16 |
| 105.0 | 617 | 570 | 324 | 135 | 55 | 24 | 24 | 32 | 16 |
| 107.5 | 855 | 768 | 427 | 174 | 63 | 32 | 32 | 32 | 32 |
| 110.0 | 1203 | 1021 | 554 | 222 | 95 | 32 | 32 | 32 | 32 |
| 112.5 | 1630 | 1345 | 696 | 285 | 111 | 32 | 32 | 32 | 32 |
| 115.0 | 2057 | 1701 | 847 | 340 | 142 | 32 | 32 | 32 | 32 |
| 117.5 | 2500 | 2041 | 997 | 396 | 174 | 32 | 32 | 32 | 32 |
| 120.0 | 2959 | 2358 | 1147 | 459 | 214 | 47 | 32 | 32 | 32 |
| 122.5 | 3371 | 2627 | 1250 | 522 | 253 | 47 | 32 | 32 | 32 |
| 125.0 | 3640 | 2817 | 1329 | 586 | 285 | 47 | 32 | 32 | 47 |
| 127.5 | 3624 | 2833 | 1361 | 657 | 324 | 47 | 32 | 40 | 47 |
| 130.0 | 3387 | 2682 | 1345 | 696 | 372 | 55 | 47 | 47 | 47 |
| 132.5 | 3007 | 2453 | 1313 | 736 | 404 | 71 | 47 | 47 | 47 |
| 135.0 | 2595 | 2239 | 1298 | 760 | 435 | 79 | 47 | 47 | 63 |
| 137.5 | 2200 | 2049 | 1298 | 775 | 451 | 95 | 63 | 63 | 63 |
| 140.0 | 1899 | 1875 | 1290 | 799 | 483 | 111 | 63 | 63 | 63 |
| 142.5 | 1709 | 1709 | 1274 | 815 | 506 | 135 | 71 | 63 | 63 |
| 145.0 | 1614 | 1598 | 1274 | 823 | 530 | 158 | 87 | 79 | 79 |
| 147.5 | 1535 | 1503 | 1266 | 863 | 554 | 190 | 103 | 79 | 79 |
| 150.0 | 1456 | 1432 | 1258 | 902 | 586 | 222 | 111 | 95 | 79 |
| 152.5 | 1393 | 1369 | 1242 | 942 | 617 | 269 | 127 | 103 | 95 |
| 155.0 | 1345 | 1337 | 1226 | 973 | 641 | 301 | 142 | 111 | 95 |
| 157.5 | 1313 | 1306 | 1226 | 1013 | 681 | 348 | 174 | 135 | 127 |
| 160.0 | 1282 | 1274 | 1219 | 1029 | 704 | 396 | 214 | 150 | 142 |
| 162.5 | 1266 | 1258 | 1211 | 1029 | 736 | 451 | 261 | 182 | 158 |
| 165.0 | 1234 | 1234 | 1179 | 1013 | 752 | 506 | 309 | 230 | 206 |
| 167.5 | 1219 | 1203 | 1147 | 981 | 768 | 562 | 380 | 293 | 269 |
| 170.0 | 1187 | 1163 | 1092 | 950 | 783 | 617 | 459 | 380 | 332 |
| 172.5 | 1124 | 1092 | 1037 | 926 | 807 | 665 | 546 | 483 | 443 |
| 175.0 | 1029 | 997 | 957 | 894 | 807 | 728 | 641 | 601 | 570 |
| 177.5 | 918 | 894 | 886 | 855 | 815 | 783 | 736 | 712 | 696 |
| 180.0 | 813 | 813 | 813 | 813 | 813 | 813 | 813 | 813 | 813 |

is the angular direction into the wall from the lighting unit 10. The vertical angles 90.0, 92.5, 95.0, 97.5, etc. are the angular directional components along the vertical plane 24 with 0° representing directly downward (the "nadir") and 180° representing directly upward. The candela distribution can therefore represent the entire sphere of solid angles including 0°-360° in angular components in each of the two defined planes 22 and 24.

As can readily be noted, the light output from the lighting unit 10 is not directed solely onto the ceiling and instead defines a preferred form of efficient light distribution on both the wall and ceiling. The light distribution can therefore be arranged to have a high level of output at 0° forward in the horizontal plane 22 and 125° in the vertical plane 24 for directing light forward away from the wall area. The gradual decrease in candela values from 125°-180° in the vertical plane 24 will provide lesser levels of light on the ceiling directly above the lighting unit 10. More light is then projected onto the ceiling away from the wall for a more pleasing, even ceiling illumination, thereby avoiding large light gradients. The relatively smaller amount of light projected onto the wall is intended to emphasize the origin of the specific source of illumination on both the wall and ceiling. Such a feature enables illuminating the wall alone or a painting or other object on the wall, while also providing ceiling illumination.

TABLE II-A

| ZONAL LUMEN SUMMARY | |
|---|---|
| 90-95 | 9. |
| 95-100 | 35. |
| 100-105 | 70. |
| 105-110 | 129. |
| 110-115 | 213. |
| 115-120 | 302. |
| 120-125 | 374. |
| 125-130 | 388. |
| 130-135 | 333. |
| 135-140 | 274. |
| 140-145 | 228. |
| 145-150 | 197. |
| 150-155 | 171. |
| 155-160 | 147. |
| 160-165 | 120. |
| 165-170 | 90. |
| 170-175 | 57. |
| 175-180 | 19. |

TABLE II-B

| ZONAL LUMEN SUMMARY | | | |
|---|---|---|---|
| ZONE | LUMENS | % LAMP | % FIXT |
| 0-90 | 0 | 0.0 | 0.0 |
| 90-120 | 759 | 15.2 | 24.0 |
| 90-130 | 1520 | 30.4 | 48.1 |
| 90-150 | 2553 | 51.1 | 80.8 |
| 90-180 | 3157 | 63.1 | 100.0 |
| 0-180 | 3157 | 63.1 | 100.0 |

TOTAL LUMINAIRE EFFICIENCY = 63.1%
CIE TYPE - INDIRECT

The design of the lighting unit 10 gives rise to a high degree of efficiency as measured by zonal lumen testing. Tables IIA and IIB shows the total number of lumens, the percentage of lamp lumens and the percentage of fixture lumens throughout the vertical planar zones. Over the vertical angular range of 0° through 90°, there is no measurable light output. From 90°-120° there are 759 lumens, which is about 15.2% of the total lumens produced and 24.0% of the total light output of the lighting unit 10. The lumens measured over 0°-180° represents the entire output of the lighting unit 10. Since the total measured lumens from the lighting unit are 3157 and the total possible lamp lumens are 5000, the percentage of lamp lumens projected by the lighting unit are 63.1%. That is, the efficiency of the lighting unit 10 is 63.1%. This can be compared to the best known previous efficiency of 40.4% for conventional prior art lighting fixtures intended for the same purpose as the instant invention (see FIG. 4B and Table IV for a zonal lumen illustration and summary for such a conventional fixture).

Figure 4A:
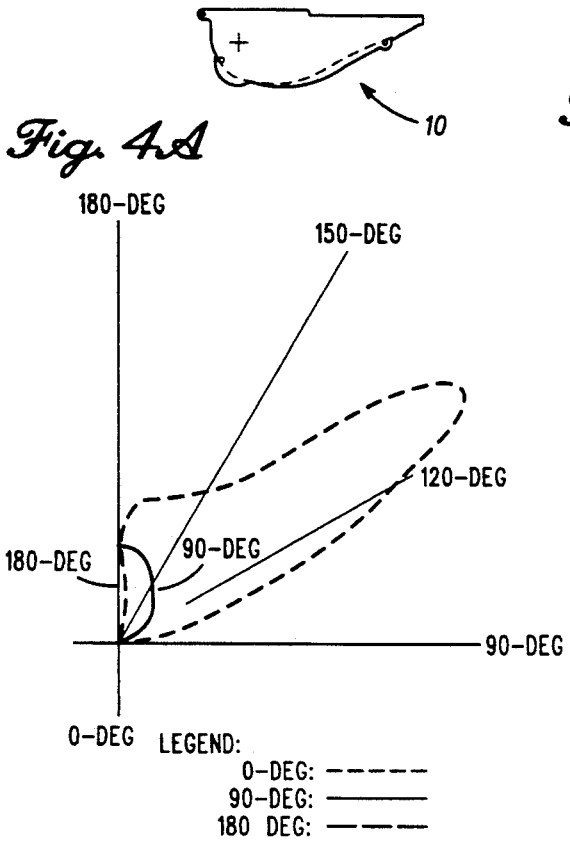
FIG. 4A illustrates the candela distribution of light for the lighting unit (illustrated in cross section) over 90°-180° and FIG. 4B shows by comparison the candela distribution for a prior art lighting unit (illustrated in cross section)
Figure 4B:
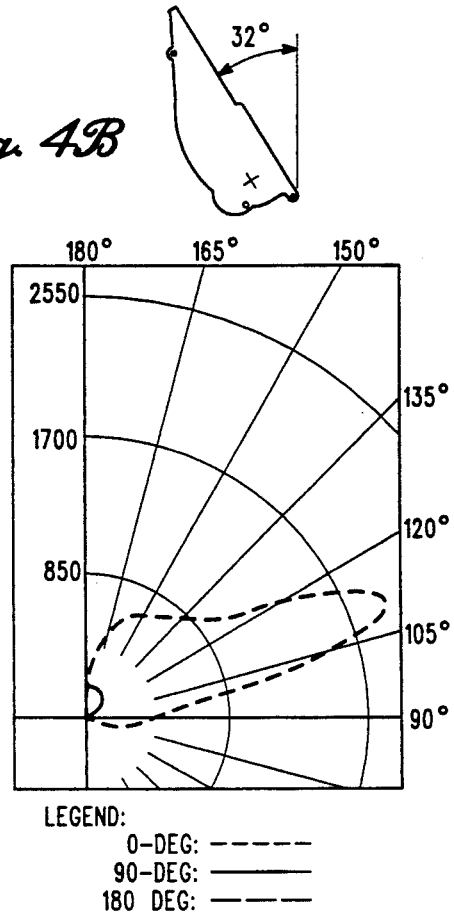
Figure 5:
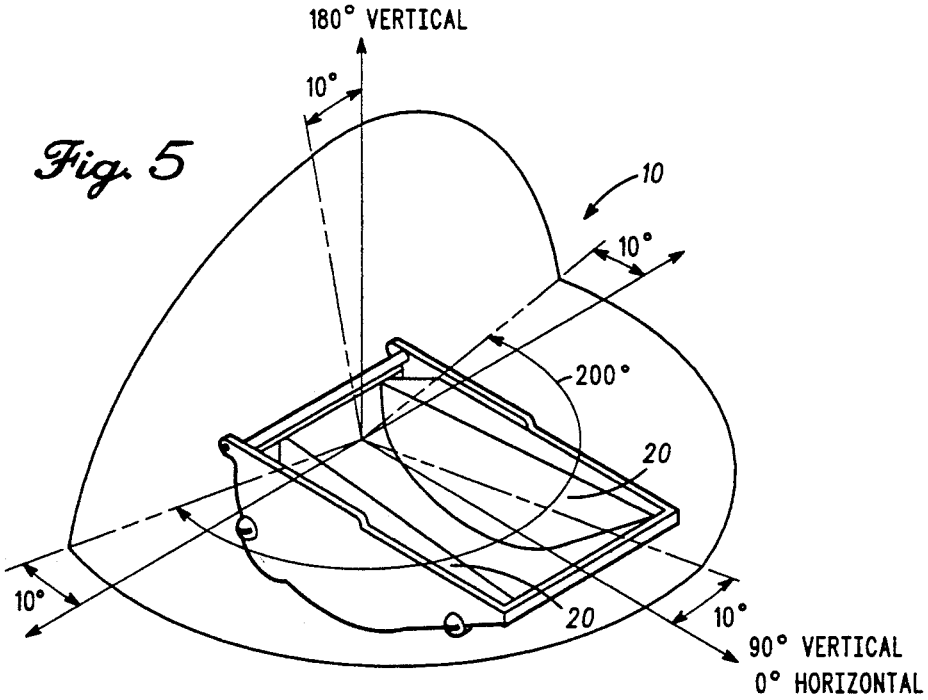
FIG. 5 illustrates another perspective view of the lighting unit and a schematic view of the lighting pattern including side illumination.

FIG. 4A further illustrates a plot of the light distribution from the lighting unit 10, wherein 0° is a direction in the vertical plane through the center of the primary reflection element 12, 90° is the distribution of light perpendicular to the 0° plane and along the wall. The 180° represents the light directed at the wall.

Further test data indicative of the efficiency of the lighting unit 10 is shown in Table III, Coefficients of Utilization. These data were taken by the conventional Zonal Cavity Method with the effective floor cavity reflectance of 0.20. For comparison, see Table IV for the prior art lighting fixture in FIG. 4B and compare to Table II and FIG. 4A. In view of the substantial efficiency of the lighting unit 10, the number of fixtures needed to illuminate a given room size and reflectance character would be less than conventional units thus reducing energy consumption.

TABLE III

COEFFICIENTS OF UTILIZATION - ZONAL CAVITY METHOD
EFFECTIVE FLOOR CAVITY REFLECTANCE 0.20

| RC | 80 | | | | 70 | | | | 50 | | | 30 | | | 10 | | | 0 |
|---|---|---|---|---|---|---|---|---|---|---|---|---|---|---|---|---|---|---|
| RW | 70 | 50 | 30 | 10 | 70 | 50 | 30 | 10 | 50 | 30 | 10 | 50 | 30 | 10 | 50 | 30 | 10 | 0 |
| 0 | 60 | 60 | 60 | 60 | 51 | 51 | 51 | 51 | 35 | 35 | 35 | 20 | 20 | 20 | 6 | 6 | 6 | 0 |
| 1 | 55 | 52 | 50 | 48 | 47 | 45 | 43 | 41 | 31 | 29 | 28 | 18 | 17 | 17 | 6 | 5 | 5 | 0 |
| 2 | 50 | 45 | 42 | 39 | 42 | 39 | 36 | 34 | 27 | 25 | 24 | 15 | 15 | 14 | 5 | 5 | 4 | 0 |
| 3 | 45 | 40 | 36 | 32 | 39 | 34 | 31 | 28 | 23 | 21 | 20 | 14 | 12 | 12 | 4 | 4 | 4 | 0 |
| 4 | 41 | 35 | 31 | 27 | 35 | 30 | 26 | 24 | 21 | 18 | 17 | 12 | 11 | 10 | 4 | 4 | 3 | 0 |
| 5 | 38 | 31 | 26 | 23 | 32 | 27 | 23 | 20 | 18 | 16 | 14 | 11 | 9 | 8 | 3 | 3 | 3 | 0 |
| 6 | 35 | 28 | 23 | 20 | 29 | 24 | 20 | 17 | 16 | 14 | 12 | 10 | 8 | 7 | 3 | 3 | 2 | 0 |
| 7 | 32 | 25 | 20 | 17 | 27 | 21 | 17 | 15 | 15 | 12 | 10 | 9 | 7 | 6 | 3 | 2 | 2 | 0 |
| 8 | 28 | 22 | 18 | 15 | 25 | 19 | 15 | 13 | 13 | 11 | 9 | 8 | 6 | 5 | 2 | 2 | 2 | 0 |
| 9 | 27 | 20 | 16 | 13 | 23 | 17 | 14 | 11 | 12 | 10 | 8 | 7 | 6 | 5 | 2 | 2 | 2 | 0 |
| 10 | 25 | 18 | 14 | 11 | 22 | 16 | 12 | 10 | 11 | 9 | 7 | 6 | 5 | 4 | 2 | 2 | 1 | 0 |

ALL CANDELA, LUMENS, LUMINANCE, COEFFICIENT OF UTILIZATION AND VCP VALUES IN THIS REPORT ARE BASED ON RELATIVE PHOTOMETRY WHICH ASSUMES A BALLAST FACTOR 1.000. ANY CALCULATIONS PREPARED FROM THESE DATA SHOULD INCLUDE AN APPROPRIATE BALLAST FACTOR.

NOTE:

THE ZONAL CAVITY CALCULATION TECHNIQUE IS ACCURATE WHEN LUMINAIRES WITH SYMMETRIC CANDELA DISTRIBUTIONS ARE EMPLOYED AND WHEN THE LUMINAIRES ARE LOCATED SYMMETRICALLY THROUGHOUT THE ROOM. THIS UNIT HAS SPECIAL CHARACTERISTICS AND THEREFORE THESE COEFFICIENTS SHOULD BE USED WITH CAUTION.

TABLE IV

ZONAL LUMEN SUMMARY

| ZONE | LUMENS | % LAMP | % FIXT |
|---|---|---|---|
| 0–30 | 0 | 0.0 | 0.0 |
| 0–40 | 0 | 0.0 | 0.0 |
| 0–60 | 15 | 0.3 | 0.7 |
| 0–90 | 150 | 3.0 | 7.4 |
| 90–120 | 1000 | 20.0 | 49.4 |
| 90–130 | 1279 | 25.6 | 63.3 |
| 90–150 | 1672 | 33.4 | 82.7 |
| 90–180 | 1872 | 37.4 | 92.6 |
| 0–180 | 2022 | 40.4 | 100.0 |

TOTAL LUMINAIRE EFFICIENCY = 40.4%
CIE TYPE - INDIRECT

Figure 3:
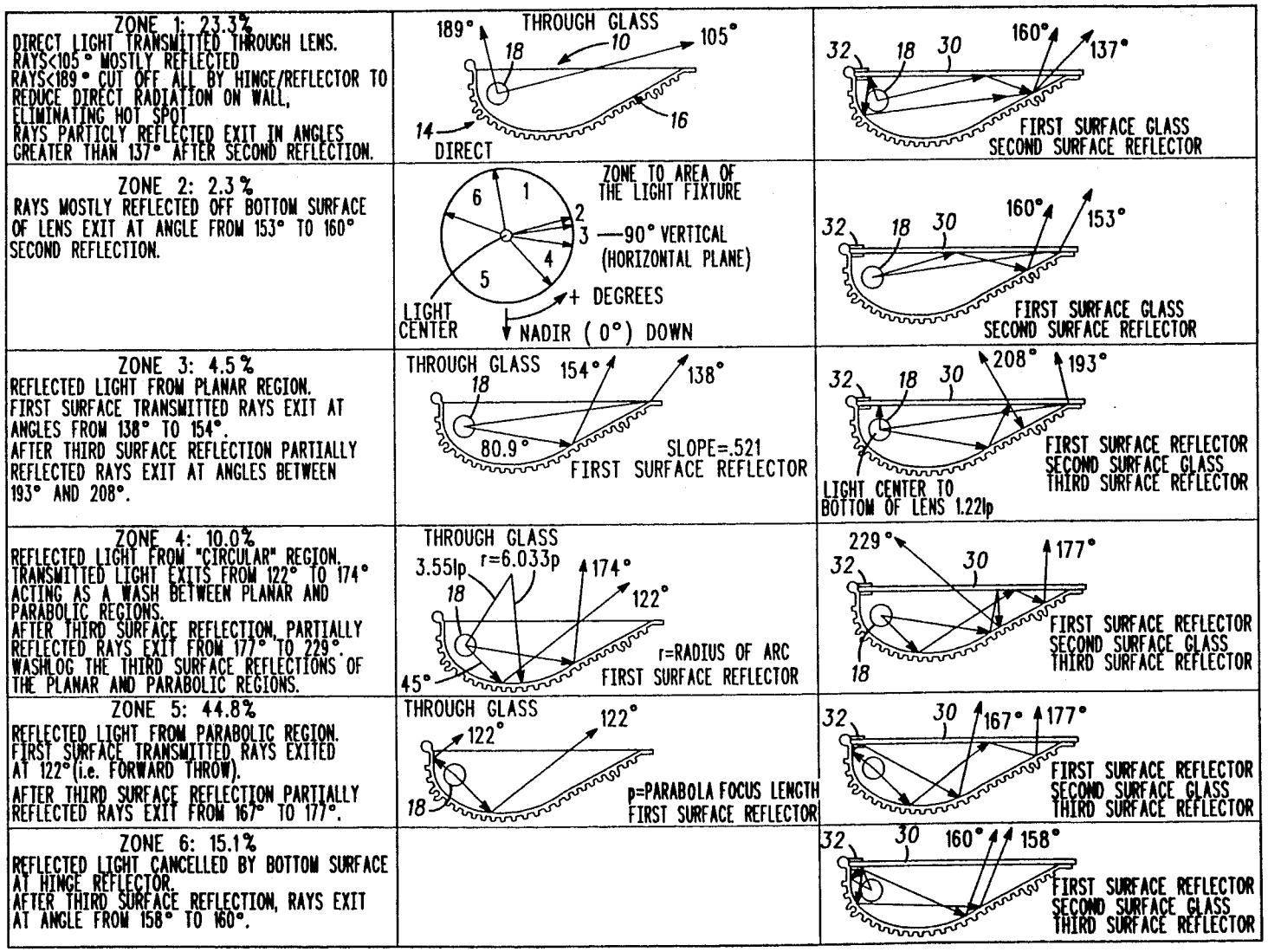
FIG. 3 illustrates light ray traces for the prominent areas of the primary reflective surfaces of the lighting fixture and the approximate light percentages associated therewith.

The lighting unit 10 derives substantial advantages and the high efficiency from the design of the primary reflector element 12 and side reflector elements 20 of the lighting unit 10. In the vertical plane 24 and considering only the primary reflector element 12, as best seen in FIG. 3, light emitted from the light source 18 can travel along a range of angles. Various portions of these range of angles can be examined in the segmented FIG. 3. For example, in terms of the 360° range of initial angle of output from the light source 18, one can determine the various dominant transmissive and reflective events which can occur. As shown in FIG. 1, the illustrated portion of the lighting unit 10 includes the primary reflection element 12, a glass diffuser cover 30 and a hinge element 32.

In Zone 1, in FIG. 3, wherein 23.1% of the light is provided, the light rays at an angle below about 105° are mostly reflected off the glass cover 30. The light rays above about 189° are cut off by the hinge element 32 which thus acts to reduce any hot spots, or large light intensity spikes, on the wall. Those light rays which are reflected off the planar portion 16 of the primary reflection element 12 (either a primary or reflected light ray), are transmitted through the glass cover 30 for angles above about 137°.

In Zone 2 about 2.3% of the light is produced when light rays are reflected off the glass cover 30 and exit if oriented at angles from about 153°–160°.

In Zone 3 about 4.5% of the light is produced by reflection of light rays only from the planar portion 16. Those light rays which are reflected from the planar portion 16 and are transmitted through the glass cover 30 lie within about 138°–154°. For those light rays which reflect three times before transmission, the approximate angular range of exit is between about 193°–208°.

In Zone 4 about 10% of the light is provided by light reflected from the semi-parabolic, curved portion 14. This shape can also be well approximated by a series of circular cross sections of changing radius of curvature. For light rays which are reflected once from the curved portion 14 and then transmitted over angles of 122°–174°, acting as a source of light to "wash" or make a smooth illumination transition between the curved portion 14 and the planar portion 16. In the case of light rays undergoing three reflections before transmission, the range of angles of transmission is about 177°–229° which acts to wash the three surface reflections from the curved portion 14 and the planar portion 16.

In Zone 5 about 44.8% of the light is provided from reflected light from the curved portion 14. Those light rays reflected once from the curved portion 14 are transmitted through the glass cover 30 at an angle of about 122°. For those light rays which are reflected three times and then transmitted, the range of angles is about 167°–177°.

In Zone 6 about 15.1% of the light is provided from light reflected three times with the angle of transmission between 158°–160°. A substantial portion of the light rays are screened by the bottom surface of the hinge element 32. This prevents unwanted illumination of the wall.

Additional advantages of the lighting unit 10 arise from the side reflectors 20 shown in FIGS. 1B–1E. The side reflectors 20 provide several advantageous features: (1) they image the lamp filament of the light source 18 by performing a single surface reflection in a region bounded by a vertical plane rotated perpendicular to the lamp axis (the 90° horizontal plane), a plane tilted perpendicular to the lamp axis plus 10° from horizontal (100° on the vertical plane), a plane tilted perpendicular to the lamp axis minus 10° from the horizontal plane (80° vertical), and a plane tilted along the lamp axis plus 10° from the horizontal (100° in the vertical plane), (2) they image the reflection element 12 in the same region recited above for the primary reflection element 12 (can be, for example, second, third and fourth surface reflections) and (3) they serve as a heat flow chimney by allowing free air convention to dissipate heat from the lighting unit 10. In other words, the side reflector element comprises a convective heat chimney for removal of heat from the lighting unit through a chimney opening, such as the aperture shown in FIGS. 2, 5, and 1B at the upper left hand corner of the side reflector element 20 and near the opening of the diffuser element. These openings together acts as a convective heat flow chimney to dissipate heat arising from the light source. Without such convection the size of the lighting unit 10 would have to be much larger (but the same 250 watts) to dissipate the heat to maintain the temperature below the maximum permissible levels for the particular materials used. FIG. 5 illustrates schematically the advantageous illumination pattern derived from the side reflectors 20. The combination of side reflectors 20 and the primary reflection element 12 combine to reflect about 75% of the light leaving the light source 18.

While preferred embodiments of the invention have been shown and described, it will be clear to those skilled in the art that various changes and modifications can be made without departing from the invention in its broader aspects as set forth in the claims provided hereinafter.

What is claimed is:

1. A lighting unit, comprising:

a primary reflection element having a curved portion and a smoothly coupled planar portion;

a side reflector element disposed adjacent to said primary reflection element and is tilted about 0°-20° from parallel with a vertical plane relative to said primary reflection element, said primary reflection element and said side reflector element providing illumination of a wall and adjacent ceiling;

a light source positioned within said lighting unit and capable of outputting light for reflection by said primary reflection element and said side reflector element; and a diffuser cover capable of being opened for access to said light source and of being closed to operate as a light diffuser element for said lighting unit.

2. The lighting unit as defined in claim 1 wherein said primary reflection element includes a plurality of circular surfaces of differing radius of curvature.

3. The lighting unit as defined in claim 1 further including a one piece spring clip holding said diffuser cover.

4. The lighting unit as defined in claim 1 wherein a candela distribution is provided using said primary reflection element with a parabolic region nearest said light source and a circular region adjacent said parabolic region.

5. The lighting unit as defined in claim 1 wherein the lighting efficiency is about 63%.

6. The lighting unit as defined in claim 1 further including a hinge element coupled to said different cover and adapted to screen out unwanted illumination of the wall adjacent to said unit.

7. The lighting unit as defined in claim 1 wherein light illumination is provided form said curved portion and said planar portion with an efficiency of almost 40 percent.

8. The lighting unit as defined in claim 1 wherein said side reflector element includes a convective heat chimney for removal of heat from said lighting unit.

9. The lighting unit as defined in claim 1 wherein said side reflector element is tilted from 10°-20° from parallel with said vertical plane and rotated about 0°-25° about the line of intersection of said side reflector element and said primary reflection element.

10. The lighting unit as defined in claim 1 wherein said side reflector element is tilted about 10° from parallel with said vertical plane and rotated about 17° about the line of intersection of said side reflector element and said primary reflection element.

11. The lighting unit as defined in claim 1 wherein said diffuser cover includes circular indentations on at least one planar surface for diffusing light passing through said diffuser cover.

12. The lighting unit as defined in claim 1 wherein said light source comprises a tungsten-halogen source.

13. A light reflection unit, comprising:

a primary reflection element having a curved portion and a smoothly coupled planar portion for receiving light from a light source positionable in said light reflector unit; and a side reflector element coupled to said primary reflection element to cooperate in generation of light illumination originating from said light source and said side reflector element being tilted about 0°-20° from parallel with a vertical plane relative to said primary reflection element, said primary reflection element and said side reflector element providing illumination of a wall and adjacent ceiling.

14. The light reflector unit as defined in claim 13 wherein said side reflector element is tilted from 10°-20° from parallel with a vertical plane and rotated about 0°-25° about the line of intersection of said side reflector element and said primary reflection element.

15. The light reflection unit as defined in claim 13 wherein said side reflector element is tilted about 10° from parallel with a vertical plane and rotated about 17° about the line of intersection of said side reflector element and said primary reflection element.

16. A lighting unit, comprising:

a primary reflection element having a curved portion and a smoothly coupled planar portion;

a side reflector element disposed adjacent to said primary reflection element with said side reflector element being tilted approximately 0°-20° from parallel with a vertical plane relative to said primary reflection element, said primary reflection element and said side reflector element providing illumination of a wall and adjacent ceiling; and a light source positioned within said lighting unit and capable of outputting light for reflection by said primary reflection element and said side reflector element.

17. The lighting unit as defined in claim 16 further including a light diffuser element for diffusing light output from said light source.

18. The lighting unit as defined in claim 16 wherein said lighting unit is positioned such that said light source is inside the space defined by both planes of said ceiling and said adjacent wall.

19. The lighting unit as defined in claim 16 wherein said side reflector element is tilted from about 10°-20° from parallel relative to a vertical plane and rotated about 0°–25° about the line of intersection of said side reflector element and said primary reflection element.

20. The lighting unit as defined in claim 19 wherein said side reflector element is tilted about 10° from parallel with a vertical plane and rotated about 17° about the line of intersection of said side reflector element and said primary reflection element.

21. The lighting unit as defined in claim 16 wherein said lighting unit includes a diffuser element having an opening and said side reflector element includes an opening disposed near said opening in said diffuser element with said openings together acting as a convective heat flow chimney to dissipate heat arising from said light source.

22. The lighting unit as defined in claim 16 wherein said curved portion comprises a parabolic section and an adjacent circular section.

23. The lighting unit as defined in claim 21 wherein said planar portion includes a region of linear slope of about one half.

* * * * *